US005628444A

United States Patent [19]

White

[11] Patent Number: 5,628,444

[45] Date of Patent: May 13, 1997

[54] FASTENER DRIVING DEVICE WITH MAIN VALVE/FRAME VALVE ARRANGEMENT

[75] Inventor: Brian M. White, Riverside, R.I.

[73] Assignee: Stanley-Bostitch, Inc., East Greenwich, R.I.

[21] Appl. No.: 559,240

[22] Filed: Nov. 16, 1995

[51] Int. Cl.[6] ..... B25C 1/04

[52] U.S. Cl. ..... 227/130; 91/308; 91/321

[58] Field of Search ..... 227/130, 8, 120; 91/307, 308, 309, 274, 321

[56] References Cited

U.S. PATENT DOCUMENTS

| | | | |
|---|---|---|---|
| 3,035,268 | 5/1962 | Goldring . | |
| 3,301,456 | 1/1967 | Schafroth . | |
| 3,477,629 | 11/1969 | Becht | 227/130 |
| 3,583,496 | 6/1971 | Fehrs | 227/130 |
| 3,908,884 | 9/1975 | Schrepferman . | |
| 4,030,655 | 6/1977 | Rothfuss et al. | 227/130 |
| 4,480,528 | 11/1984 | Shiroyama | 227/130 |
| 4,915,013 | 4/1990 | Moraht . | |
| 5,131,797 | 7/1992 | Okushima et al. | 227/130 |
| 5,370,037 | 12/1994 | Bauer . | |
| 5,511,714 | 4/1996 | Bauer et al. | 227/130 |

*Primary Examiner*—Scott A. Smith
*Attorney, Agent, or Firm*—Cushman Darby & Cushman IP Group of Pillsbury Madison & Sutro LLP

[57] ABSTRACT

A control module for a pneumatically operated fastener driving device is constructed and arranged to be mounted with respect to a main frame portion of the device housing so as to open a passageway to operate the device. The control valve module includes a control module housing assembly providing an exhaust passage; a main valve mounted for movement between opened and closed positions for opening and closing the passageway; spring structure biasing the main valve towards its closed position, exhaust seal structure having an annular valve element operatively associated with the main valve for closing the exhaust passage when the main valve is disposed in its opened position; an actuating member mounted for movement from a sealed position into an unsealed position for initialing movement of the main valve to its opened position; and a trigger assembly mounted for movement from an inoperative position into an operating position, such that movement of the trigger assembly from its inoperative position to its operating position moves the actuating member from its normal position to its operative position. The control module being constructed and arranged so as to be mounted to and removable from the main frame portion of the device housing as a unit.

12 Claims, 5 Drawing Sheets

FASTENER DRIVING DEVICE WITH MAIN VALVE/FRAME VALVE ARRANGEMENT

This invention relates to a fastener driving device and, more particularly, to an air operated fastener driving device having a control module including a main valve disposed in a frame portion of the device housing.

Conventional fastener driving devices typically include a main valve disposed above a cylinder sleeve which houses a piston and cylinder unit. The main valve is pilot pressure operated and moveable from a closed position to an opened position permitting air under pressure to communicate with the piston and cylinder unit for initiating a fastener drive stroke. This main valve/sleeve valve arrangement has proven to be efficient, but adds to the overall height of the device. In addition, the conventional arrangement is costly to assemble and service.

Certain fastener driving devices such as wire upholstery tackers have a low-profile requirement. Therefore, the conventional main valve/sleeve valve arrangement described above is not acceptable.

An object of the present invention is the provision of a fastener driving device having a low-profile design. Another object of the invention is the provision of a fastener driving device which is simple in construction, effective in operation and economical to manufacture and maintain.

These objectives are obtained by providing a pneumatically operated fastener driving device including a housing having a cylindrical housing portion and a main frame portion extending laterally from the cylindrical housing portion. The cylindrical portion defines a fastener drive track. A fastener magazine is provided for feeding successive fasteners laterally into the drive track. A fastener driving element is slidably mounted in the drive track for movement through an operative cycle including a drive stroke during which a fastener within the drive track is engaged and moved longitudinally outwardly of the drive track into a workpiece and a return stroke. A drive piston is connected with the fastener driving element. A cylinder is defined in the cylindrical housing portion and the piston is reciprocally mounted in the cylinder. An air pressure reservoir communicates with the one end of the cylinder through a passageway.

In accordance with the principles of the invention, a control module is provided for opening the passageway and communicating reservoir pressure with the cylinder at the one end thereof to move the piston in a direction to effect the drive stroke of the fastener driving element and for closing the passageway and communicating the one end of the cylinder with atmosphere for permitting the piston to move in a direction to effect the return stroke of the fastener driving element.

The control valve module includes a control module housing assembly mounted in the main frame portion of the housing and providing an exhaust passage for communicating the one end of the cylinder with atmosphere; a cylindrical main valve mounted with respect to the control module housing assembly for movement between opened and closed positions to open and close the passageway, the main valve having a first pressure area defining with a portion of the control module housing assembly a control pressure chamber, the main valve including a second pressure area in opposing relation to the first pressure area; spring structure biasing the main valve towards its closed position; exhaust seal structure fixed to the control module housing assembly and having an annular valve element operatively associated with the main valve for closing the exhaust passage when the main valve is disposed in its opened position; an actuating member mounted with respect to the control module housing assembly and being constructed and arranged to move from a normal, sealed position into an operative, unsealed position for initialing movement of the main valve to its opened position thereby opening the passageway and initiating movement of the fastener driving element through a fastener drive stroke, and a trigger assembly mounted with respect to the control module housing assembly for manual movement from a normal, inoperative position into an operating position, such that movement of the trigger assembly from its inoperative position to its operating position moves the actuating member from its normal, sealed position to its operative, unsealed position.

The actuating member controls pressure in the control pressure chamber such that when the actuating member is in its operative, unsealed position, reservoir pressure in the control pressure chamber acting on the first pressure area is released to atmosphere such that pressure acting on the second pressure area moves the main valve against the bias of the spring structure to its opened position initiating a fastener drive stroke. The main valve engages the annular valve element of the exhaust seal structure when the main valve is in its opened position, thereby closing the exhaust passage and preventing the one end of the cylinder to communicate with atmosphere. The control module is constructed and arranged with respect to the main frame portion of the housing so as to be removable therefrom as a unit.

These and other objects of the present invention will become more apparent during the course of the following detailed description and appended claims.

The invention may be best understood with reference to the accompanying drawings wherein an illustrative embodiment is shown.

IN THE DRAWINGS

Figure 1:
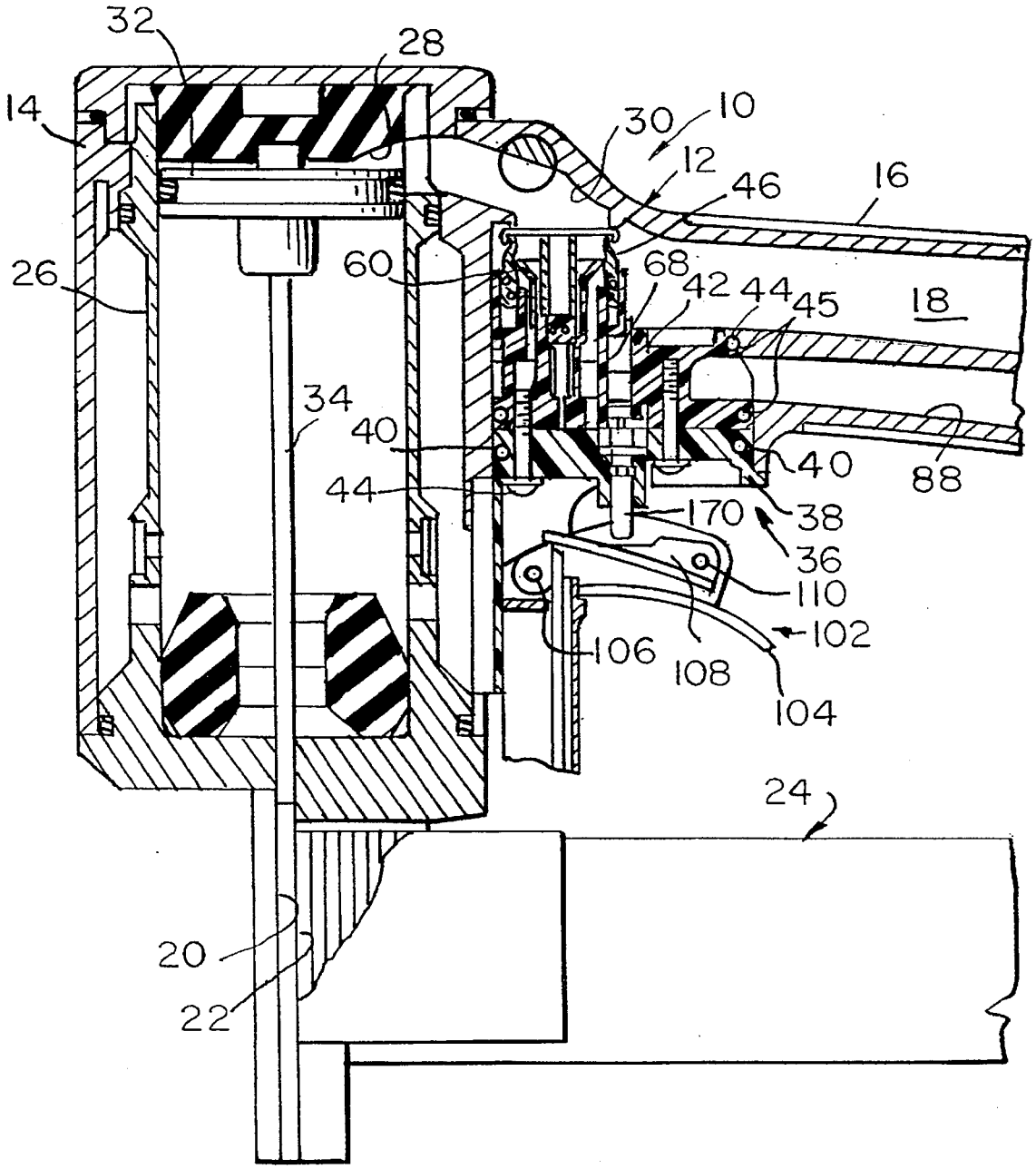
FIG. 1 is view of a fastener driving device, shown partially in section, including a control module provided in accordance with the principles of the present invention.

Referring now more particularly to the drawings, a pneumatically operated fastener driving device, generally indicated at 10, is shown in FIG. 1, which embodies the principles of the present invention. The device 10 includes a housing, generally indicated at 12, which includes a cylindrical housing portion 16 and a main frame portion 16 extending laterally from the cylindrical housing portion 14.

The main frame portion defines a hand grip portion of hollow configuration which constitutes a reservoir chamber 18 for containing air under pressure coming from a source which is communicated therewith. The cylindrical portion of the housing 12 includes the usual nose piece defining a fastener drive track 20 which is adapted to receive laterally therein the leading fastener 22 from a package of fasteners mounted within a magazine assembly, generally indicated at 24, of conventional construction and operation. Mounted within the cylindrical portion of housing 12 is a cylinder 26 which has its upper end 28 disposed in communicating relation exteriorly with the reservoir chamber 18 via a passageway 30. Mounted within the cylinder 26 is a piston 32. Carried by the piston 32 is a fastener driving element 34 which is slidably mounted within the drive track 20 and movable by the piston 32 through a cycle of operation which includes a drive stroke during which the fastener driving element 34 engages a fastener within the drive track 20 and moves the same longitudinally outwardly into a workpiece, and a return stroke.

In order to effect the aforesaid cycle of operation, there is provided a control module, generally indicated at 36, constructed in accordance with the present invention. The control module 36 includes a control module housing assembly, which, in the illustrated embodiment includes a trigger housing 38 coupled to the main frame portion 18 by pin connections at 40, and a valve housing 42 secured to the trigger housing 38 by fasteners, preferably in the form of screws 44. Housings 38 and 42 are preferably molded from plastic material. O-rings 45 seal the valve housing 42 within the main frame portion of the housing 12. It can be appreciated that the control module housing assembly can be formed as a single unit.

Figure 2:
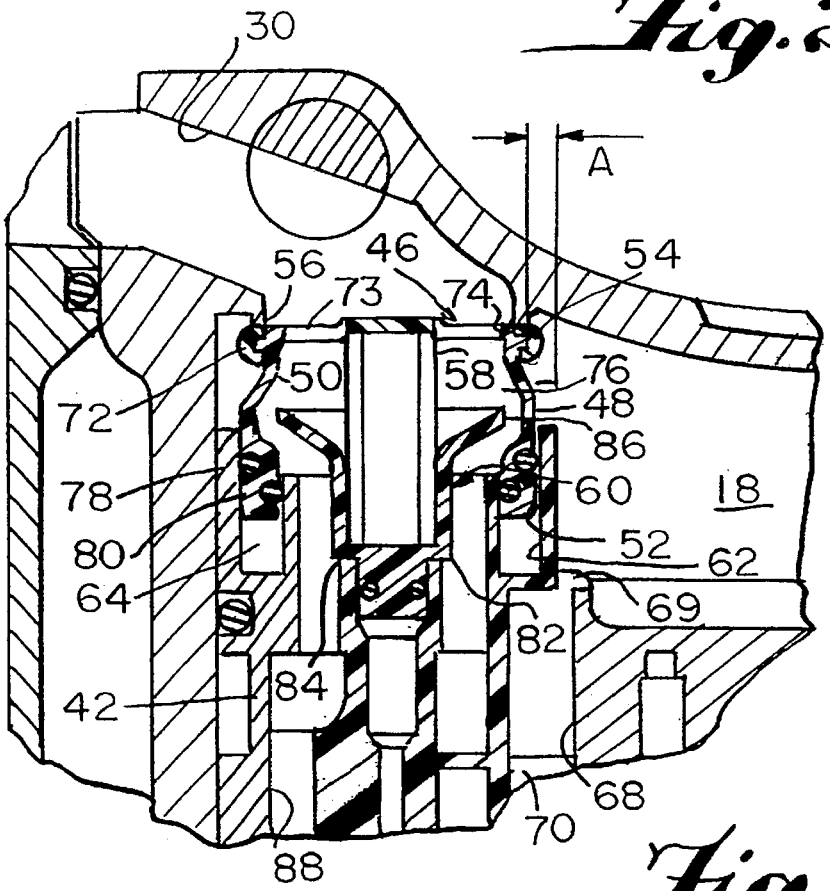
FIG. 2 is an enlarged, sectional view of a main valve of the control module shown in a closed position when the device is at rest.

The control module 36 includes a main valve 46 mounted with respect to the valve housing 42. With reference to FIG. 2, the main valve 46 is cylindrical having an outer peripheral surface 48 and an inner peripheral surface 50. The main valve 46 is mounted with respect to the passageway 30 to be moveable between opened and closed positions to open and close the passageway 30. The main valve 46 includes a first annular pressure area 52 and a second, opposing annular pressure area (A–E in the FIGS.). As shown in FIG. 2, when the device 10 is at rest with the main valve 46 in its closed position, pressure area A extends beyond annular housing seating surface 56 and is exposed to reservoir pressure. Spring structure, in the form of a coil spring 58 biases the main valve 46 to its closed position, together with reservoir pressure acting on pressure area 52. Thus, he force of the spring 58 plus the force acting on pressure area 52 is greater than the force due to pressure acting on the opposing pressure area A, which results in the keeping the main valve 46 in its closed position. The spring 58 is disposed between a surface of an exhaust seal structure, generally indicated at 60, and a surface of the main valve 46.

The first pressure area 52 together with annular groove portion 62 of the valve housing 40 define a pressure chamber 64. The pressure chamber 64 is in communication with the reservoir pressure or high pressure in chamber 18 via passageways 66 and 67 (FIG. 8) which communicate with the bore 68. Bore 68 houses an actuating member 70 and is exposed to reservoir pressure in chamber 18 via port 69. This high pressure in chamber 64 is dumped to atmosphere to open the main valve 46, as will be explained below.

A urethane seal member 72 is attached to the edge of the upper surface 73 of the main valve 46 enhancing sealing between the main valve and the housing seating surface 56 when the main valve 46 is in its closed position. In the illustrated embodiment, the upper surface 73 of the main valve 46 includes a plurality of ports 74 therein so that the passageway 30 and thus the upper end 28 of the cylinder may communicate with an exhaust passage 76, defined in the control module housing assembly, the function of which will become apparent below. O-ring seals 78 and 80 are provided for sealing the main valve 46 within the valve housing 42.

The exhaust seal structure 60 is fixed to the valve housing 42 such that surface 82 of the seal structure 60 engages surface 84 of the valve housing 42. The seal structure 60 is disposed within an interior of the main valve 46 and includes an annular valve element 86 which engages the inner peripheral surface 50 of the main valve 46 when the main valve is in its fully opened position (FIG. 4), which closes the exhaust passage 76 and prevents the upper end 28 of the cylinder from communicating with an exhaust path 88, as will be explained more fully below.

Figure 8:
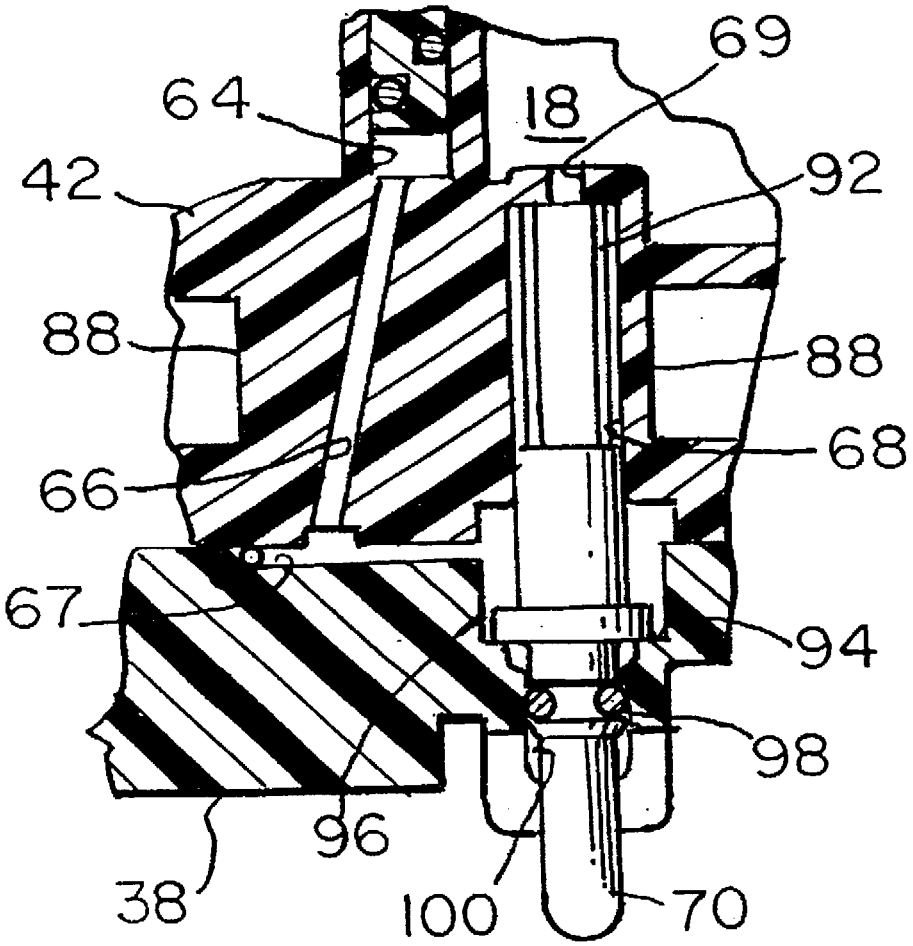
FIG. 8 is an enlarged, sectional view showing the communication passages between a pressure chamber and the actuating member.

The control module 36 includes the actuating member 70 which is carried by the module 36 for rectilinear movement from a normal, sealed position into an operative, unsealed position for initiating movement of the main valve 46 to its open position, thereby initiating movement of the fastener driving element 34 through a fastener drive stroke. The actuating member 70 is normally biased to its normal, sealed position by a coil spring 92 and reservoir pressure via port 69. As shown in FIG. 8, in the sealed position, surface 94 of actuating member 70 engages housing surface 96 and O-ring 98 is compressed, sealing an exhaust port 100.

As shown in FIG. 1, the control module 36 includes a manually operated trigger assembly, generally indicated at 102, for moving the actuating member 70. The trigger assembly includes a trigger 104 pivoted to the trigger housing 38 at pin 106 and a rocker arm 108 pivoted to the trigger 104 at pin 110. Thus, movement of the trigger 104 causes the rocker arm 108 to engage and move the actuating member 70 from its sealed position to its operative, unsealed position.

Operation

The operation of the device 10 will be appreciated with reference to the Figures. As shown in FIG. 2, when the device 10 is at rest, spring 58 together with reservoir pressure in chamber 64 acting on pressure area 52 biases the main valve 46 to its closed position. Thus, the force created by reservoir pressure acting on pressure area 52 plus the force of the spring 58 is greater than the force created by the reservoir pressure acting on pressure area A, maintaining the main valve 46 in its closed position. Over-the-piston pressure in passageway 30 is atmospheric pressure since the exhaust passage 76 is in communication with the exhaust path 88. Exhaust path 88 communicates with atmosphere at the rear of the device 10.

Figure 3:
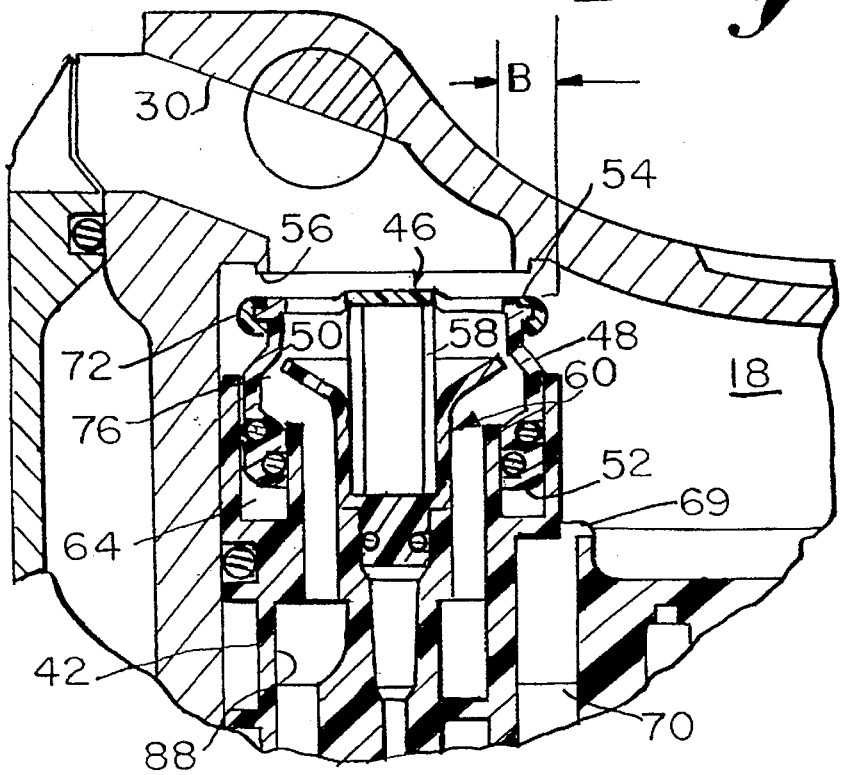
FIG. 3 is a view similar to FIG. 2, showing the main valve in an initial opening position.

To initiate a fastener drive stroke, the trigger 104 is pulled which causes the rocker arm 108 to contact the actuating member 70 moving it to its operative, unsealed position thus opening port 100. This action releases high pressure air in pressure chamber 64, under the main valve 46, via passageways 66 and 67 and exhaust port 100. Initially, since pressure area 52 of the main valve 46 is exposed to low pressure air, high pressure air acting on pressure area A overcomes the bias of spring 58 plus the low pressure air acting on area 52 and initiates movement of the main valve 46 off seating surface 56. Thereafter, the force created by reservoir pressure acting on pressure area B (FIG. 3) is again greater than the force of the spring 58 plus the force created by the atmospheric pressure acting at pressure area 52. This accelerates movement of the main valve 46 towards its opened position. As a result, the low pressure air in passageway 30 becomes high pressure air via the reservoir chamber 18 and the high pressure air forces the main valve 46 open, thus permitting the high pressure air to communicate with the one end 28 of the cylinder 26 to move the piston 32 in the direction to effect the drive stroke of the fastener driving device 10.

Figure 4:
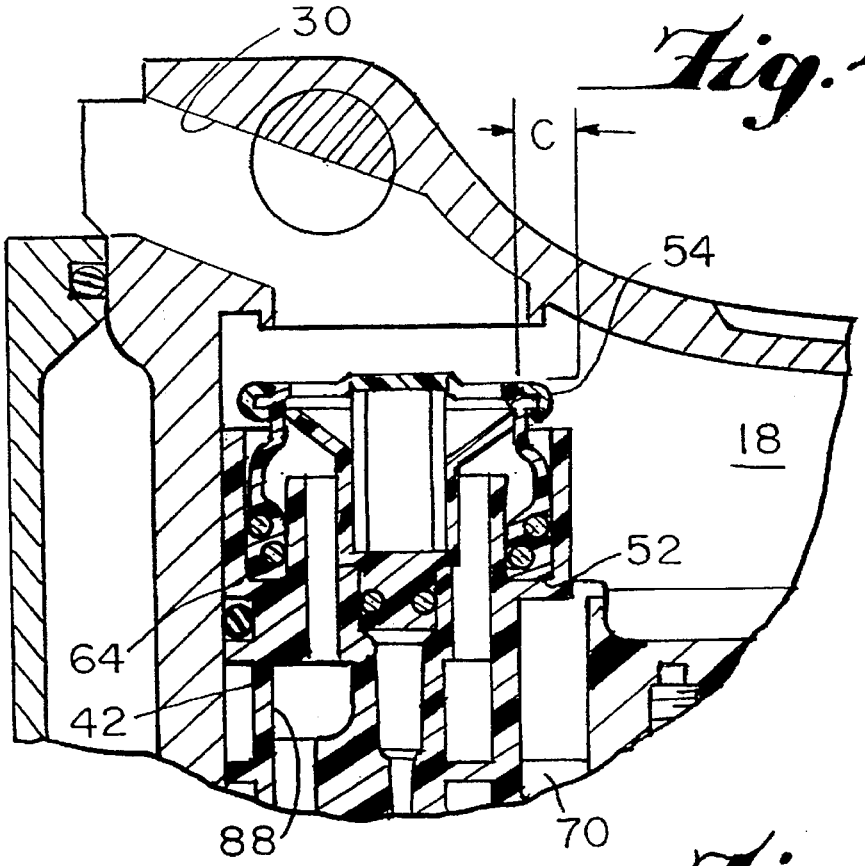
FIG. 4 is a view similar to FIG. 2, showing the main valve in its fully opened position initiating a fastener drive stroke.

As shown in FIG. 4, when the main valve 46 is opened fully, the force created by reservoir pressure acting on pressure area C is greater than the force of the spring 58 at its compressed height plus the force created by the atmospheric pressure acting on pressure area 52. In this position, the main valve 46 engages valve element 86 which closes passage 76 preventing the reservoir pressure at the upper end 28 of the cylinder from exiting the device 10 through the exhaust path 88.

Figure 5:
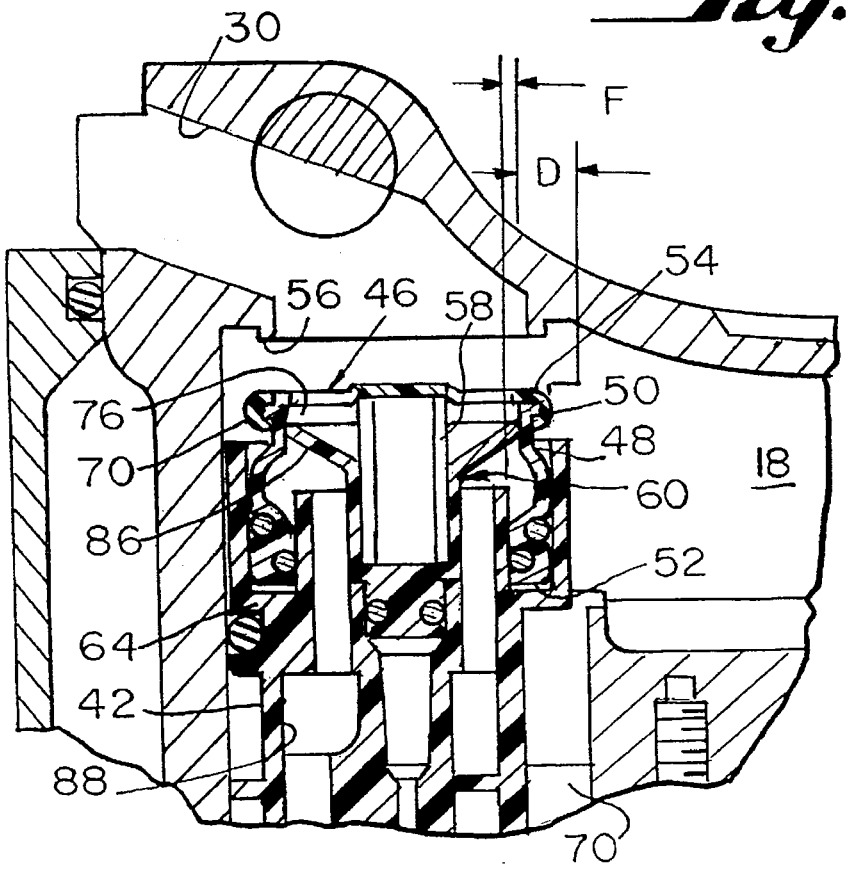
FIG. 5 is a view similar to FIG. 2, showing the main valve being initially moved to the closed position by pneumatic and spring bias.

FIG. 5 shows the initial shift of the main valve 46 to its closed position during the return stroke of the piston. Thus, when the trigger 104 is released, the actuating member 70 moves to its sealed position and reservoir pressure fills the pressure chamber 64 via port 69. At this position, the force created by reservoir pressure acting on pressure area 52 plus the force of the spring 58 is greater than the force created by the reservoir pressure at pressure area D. This causes the main valve 46 to begin to move upwardly towards its closed position. Surface area offset F creates a pneumatic bias which assists the spring 58 to overcome the friction between the main valve 46 and the exhaust seal structure 60.

Port 69 is a feed orifice which is sized to control the piston dwell at the bottom of its stroke. The area of exhaust path 100 is greater that the area of port 69 thus, high pressure in cavity 64 will decay once the O-ring 98 of the actuating member 70 is unsealed.

Figure 6:
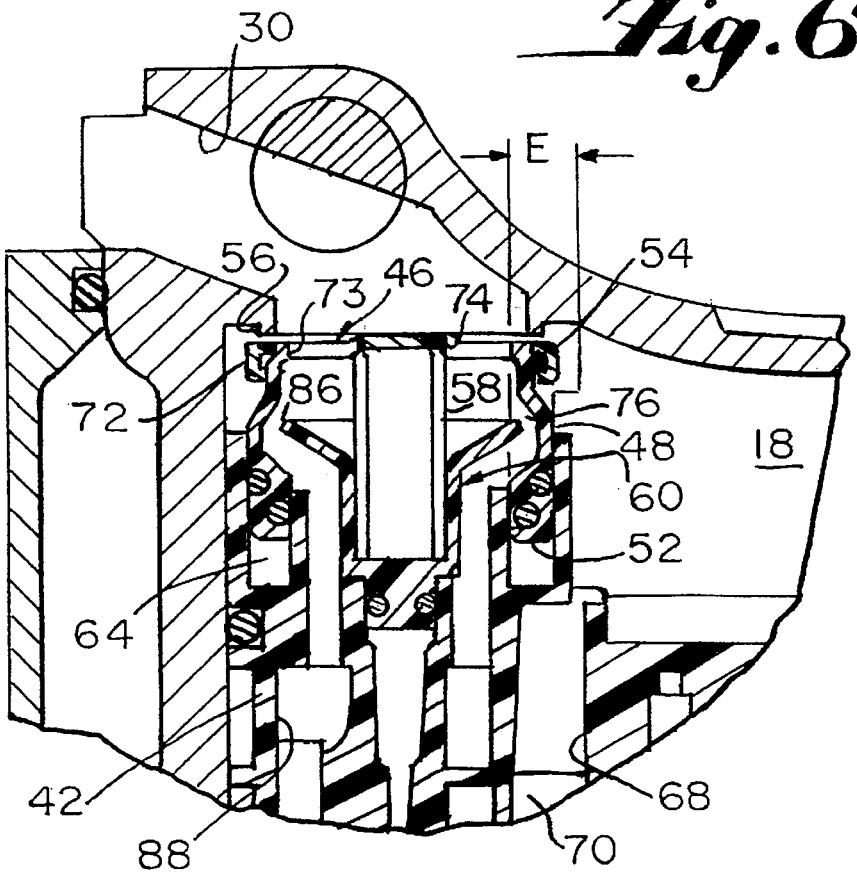
FIG. 6 is a view similar to FIG. 2, showing the main valve being moved by spring bias only to the closed position during the return stroke of device.

FIG. 6 shows the main valve 46 moving to its closed position. At this position, the force created by reservoir pressure acting on pressure area 52 plus the force of the spring 58 is greater than the force created by the reservoir pressure on pressure area E. Pressure area E is generally equal to pressure area 52. Since exhaust passage 76 is now opened, the upper end 28 of the cylinder (FIG. 1) is exposed to atmospheric pressure.

Figure 7:
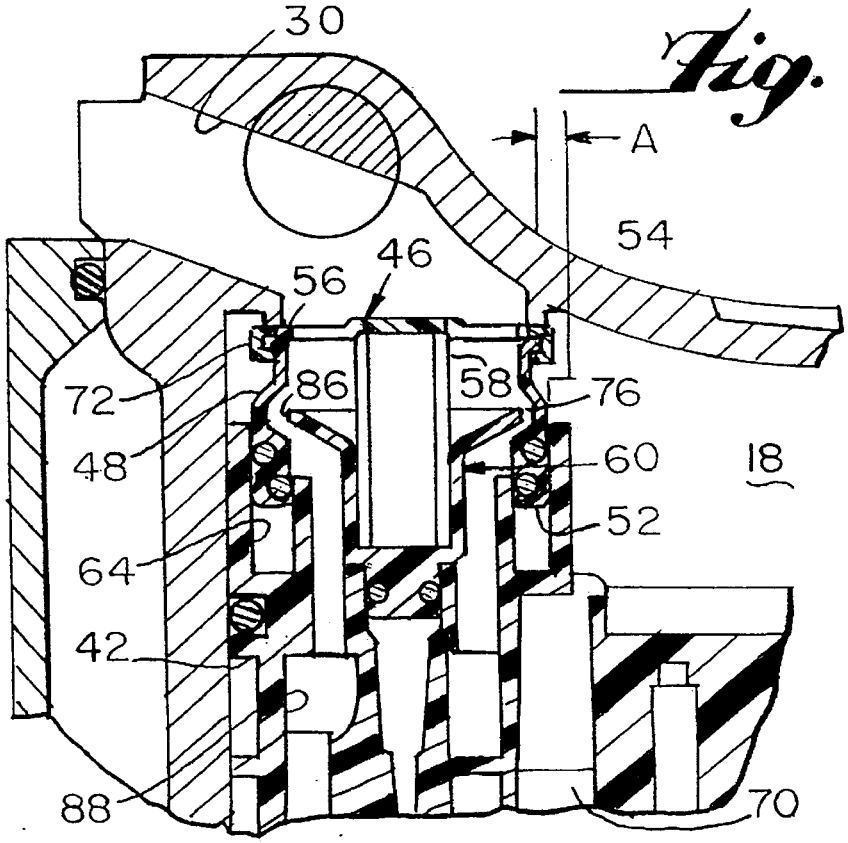
FIG. 7 is a view similar to FIG. 2, showing the main valve returned to its closed position.

FIG. 7 shown the main valve returned to its closed position, completing an operating cycle of the device 10.

The single O-ring of the actuating member 70 enhances the main valve 46 response. When the device 10 is at rest, the actuating member force equals the spring 92 force plus the pneumatic force acting on member 70 via port 69. When the actuating member 70 is moved to its unsealed position, the actuating member force equals the spring force only. This creates a poppet-like condition which tends to accelerate the actuating member 70 when the pneumatic force decays.

It can be appreciated that by positioning the main valve 46 in the frame of the device 10, the overall tool height is reduced. Further, since the valve assembly is contain within a single unit in the form of the control module 36, the device is easy to assembly and service.

It can be seen that the main valve 46 is constructed and arranged such that the inertia of the main valve 46 is in the same direction as the valve closing direction, unlike the main valve/sleeve valve arrangement. Thus, hammer actuation sensitivity may be reduced; Hammer actuation may occur when the tool is turned upsidedown and used as a hammer.

It thus will be appreciated that the objects of the invention have been fully and effectively accomplished. It will be realized, however, that the foregoing preferred embodiment of the present invention has been shown and described for the purpose of illustrating the structural and functional principles of the present invention and are subject to change without departure from such principles. Thus, the invention includes all modifications encompassed within the spirit of the following claims.

What is claimed is:

1. A pneumatically operated fastener driving device comprising:

a housing having a cylindrical housing portion and a main frame portion extending laterally from said cylindrical housing portion, said cylindrical portion defining a fastener drive track, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece and a return stroke, a drive piston connected with the fastener driving element, a cylinder, defined in said cylindrical housing portion, within which the piston is reciprocally mounted, an air pressure reservoir communicating with the one end of the cylinder through a passageway, a control module for opening said passageway and communicating reservoir pressure with the cylinder at said one end thereof to move the piston in a direction to effect the drive stroke of the fastener driving element and for closing said passageway and communicating the one end of the cylinder with atmosphere for permitting the piston to move in a direction to effect the return stroke of the fastener driving element, said control module including:

a control module housing assembly mounted in said main frame portion of said housing and providing an exhaust passage for communicating the one end of the cylinder with atmosphere, a cylindrical main valve mounted with respect to said control module housing assembly for movement between opened and closed positions to open and close said passageway, said main valve having a first pressure area defining with a portion of said control module housing assembly a control pressure chamber, said main valve including a second pressure area in opposing relation to said first pressure area, spring structure biasing said main valve towards its closed position, exhaust seal structure fixed to said control module housing assembly and having an annular valve element operatively associated with said main valve for closing said exhaust passage when said main valve is disposed in its opened position, an actuating member mounted with respect to said control module housing assembly and being constructed and arranged to move from a normal, sealed position into an operative, unsealed position for initiating movement of said main valve to its opened position thereby opening said passageway and initiating movement of the fastener driving element through a fastener drive stroke, and a trigger assembly mounted with respect to said control module housing assembly for manual movement from a normal, inoperative position into an operating position, such that movement of said trigger assembly from its inoperative position to its operating position moves said actuating member from its normal, sealed position to its operative, unsealed position, said actuating member controlling pressure in said control pressure chamber such that when said actuating member is in its operative, unsealed position, pressure in said control pressure chamber acting on said first pressure area is released to atmosphere and pressure acting on said second pressure area moves said main valve against the bias of said spring structure to its opened position initiating a fastener drive stroke, said main valve engaging said annular valve element of said exhaust seal structure when said main valve is in its opened position thereby closing said exhaust passage and preventing said one end of said cylinder to communicate with atmosphere, said control module being constructed and arranged with respect to said main frame portion of said housing so as to be removable therefrom as a unit.

2. The pneumatically operated fastener driving device according to claim 1, wherein said main frame portion defines an annular seating surface, said main valve including an annular surface which engages said seating surface when said main valve is in its closed position, and when said main valve is in its closed position, said second pressure area being defined as an area extending beyond said annular seating surface and exposed to reservoir pressure in said pressure reservoir.

3. The pneumatically operated fastener driving device according to claim 2, wherein at least a portion of said annular surface of said main valve includes a urethane seal member thereon.

4. The pneumatically operated fastener driving device according to claim 1, wherein said main valve, said exhaust seal structure and said control module housing assembly are constructed and arranged such that said exhaust passage extends between said valve element and said main valve and through a portion of said control module housing assembly, said main valve including at least one port in an upper surface thereof communicating said one end of the cylinder with said exhaust passage.

5. The pneumatically operated fastener driving device according to claim 4, wherein said exhaust seal structure is disposed within an interior portion of said main valve such that when said main valve moves to its opened position, an inner peripheral surface of said main valve engages said valve element of said exhaust seal structure to close said exhaust passage preventing said one end of the cylinder from communicating with the atmosphere.

6. The pneumatically operated fastener driving device according to claim 1, wherein said control module housing assembly includes:

a valve housing, said main valve being mounted with respect to said valve housing, and a trigger housing coupled to said valve housing, said trigger assembly being coupled to said trigger housing.

7. The pneumatically operated fastener driving device according to claim 6, wherein said valve housing is coupled to said trigger housing by fasteners and said trigger housing is coupled to said main frame portion of said housing by a pin connection so as to fix said control module to said main frame portion of said housing.

8. The pneumatically operated fastener driving device according to claim 1, wherein said actuating member is biased to its normal, sealed position by reservoir pressure and a spring force, said reservoir pressure communicating with said actuating member via a feed orifice, said feed orifice being sized to control dwell of said piston at a bottom of its stroke.

9. A control module for a pneumatically operated fastener driving device, the device including a housing having a cylindrical housing portion and a main frame portion extending laterally from the cylindrical housing portion, the cylindrical housing portion defining a fastener drive track; a fastener magazine for feeding successive fasteners laterally into the drive track; a fastener driving element slidably mounted in the drive track for movement through an operative cycle including a drive stroke during which a fastener within the drive track is engaged and moved longitudinally outwardly of the drive track into a workpiece and a return stroke; a drive piston connected with the fastener driving element; a cylinder, defined in the cylindrical housing portion, within which the piston is reciprocally mounted; an air pressure reservoir communicating with the one end of the cylinder through a passageway, the control module being constructed and arranged to be mounted with respect to the main frame portion of the housing so as to open the passageway and communicate reservoir pressure with the cylinder at the one end thereof to move the piston in a direction to effect the drive stroke of the fastener driving element and to close the passageway and communicate the one end of the cylinder with atmosphere for permitting the piston to move in a direction to effect the return stroke of the fastener driving element, said control module comprising:

a control module housing assembly constructed and arranged to be mounted in said main frame portion of the housing, the control module housing assembly providing an exhaust passage;

a cylindrical main valve mounted with respect to said control module housing assembly for movement between opened and closed positions for opening and closing the passageway, said main valve having a first pressure area defining with a portion of said control module housing assembly a control pressure chamber, said main valve including a second pressure area in opposing relation to said first pressure area, spring structure biasing said main valve towards its closed position, exhaust seal structure fixed to said control module housing assembly and having an annular valve element operatively associated with said main valve for closing the exhaust passage when said main valve is disposed in its opened position, an actuating member constructed and arranged for movement from a normal, sealed position into an operative, unsealed position for initialing movement of said main valve to its opened position, and a trigger assembly mounted for manual movement from a normal, inoperative position into an operating position, such that movement of said trigger assembly from its inoperative position to its operating position moves said actuating member from its normal position to its operative position, said control module being construed and arranged so as to be mounted to and removable from the main frame portion of the housing as a unit.

10. The control module according to claim 9, wherein said main valve, said exhaust seal structure and said control module housing assembly are constructed and arranged such that said exhaust passage extends between said valve element and said main valve and through a portion of said control module housing assembly, said main valve including at least one port in an upper surface thereof communicating said one end of the cylinder with said exhaust passage.

11. The control module according to claim 10, wherein said exhaust seal structure is disposed within an interior portion of said main valve such that when said main valve moves to its opened position, an inner peripheral surface of said main valve engages said valve element of said exhaust seal structure to close said exhaust passage preventing said one end of the cylinder from communicating with the atmosphere.

12. The control module according to claim 11, wherein said control module housing assembly includes:

a valve housing, said main valve being mounted with respect to said valve housing, and a trigger housing coupled to said valve housing, said trigger assembly being coupled to said trigger housing.

* * * * *